US005887532A

United States Patent [19]

Hollenstein et al.

[11] Patent Number: 5,887,532

[45] Date of Patent: Mar. 30, 1999

[54] METHOD AND APPARATUS FOR MANUFACTURING BOOK BLOCKS

[75] Inventors: Hans Hollenstein, Guntershausen; Heinz Bötschi, Mauren; Marcel Stolz, Felben, all of Switzerland

[73] Assignee: Grapha-Holding AG, Hergiswil, Switzerland

[21] Appl. No.: 968,734

[22] Filed: Aug. 22, 1997

[30] Foreign Application Priority Data

Sep. 25, 1996 [CH] Switzerland ..... 1996 2331/96

[51] Int. Cl.[6] ..... D05B 23/00; D05B 61/00

[52] U.S. Cl. ..... 112/21; 412/35; 270/52.18

[58] Field of Search ..... 112/21, 22, DIG. 3; 270/52.18, 58.08; 412/1, 6, 7, 35, 8

[56] References Cited

U.S. PATENT DOCUMENTS

| | | | |
|---|---|---|---|
| 3,340,838 | 9/1967 | Morris | 112/DIG. 3 |
| 3,421,465 | 1/1969 | Marek et al. | 112/21 X |
| 4,489,930 | 12/1984 | Meir . | |
| 4,630,560 | 12/1986 | Stutznacker | 112/DIG. 3 |
| 5,028,193 | 7/1991 | Misicka | 412/8 |
| 5,277,413 | 1/1994 | Boss . | |
| 5,678,813 | 10/1997 | Osako et al. | 270/52.18 X |

FOREIGN PATENT DOCUMENTS

| | | | |
|---|---|---|---|
| 2188989 | 5/1997 | Canada . | |
| 0 095 603 | 12/1983 | European Pat. Off. . | |
| 0 295 220 | 12/1988 | European Pat. Off. . | |
| 0 551 055 | 7/1993 | European Pat. Off. . | |
| 0 771 754 | 5/1997 | European Pat. Off. . | |
| 196 38 448 | 5/1997 | Germany . | |
| 272803 | 12/1968 | Russian Federation | 112/DIG. 3 |
| 1088690 | 10/1967 | United Kingdom . | |

OTHER PUBLICATIONS

European Search Report (EP 97 81 0465).
Derwent Abstract for EP 771 754.
Derwent Abstract for DE 196 38 448.
Derwent Abstracts for EP 0 551 055.
Derwent Abstracts for EP 0 295 220.
Derwent Abstracts for EP 0 095 603.

*Primary Examiner*—Ismael Izaguirre
*Attorney, Agent, or Firm*—Darby&Darby

[57] ABSTRACT

During manufacture of thread-sewn book blocks (11) from a stack of flat sequentially juxtaposed signatures (3) which are sewn together by way of a double-stranded binding thread (9) which penetrates the folds (4) from the outside and extends in sections along the inside edge of the folds and is pulled out again, the binding thread sections (16, 17) which are inserted by a first sewing needle (5) between the legs (14) of the signatures (3) are captured by a gas jet and conveyed in form of a loop (21) to the adjacent second sewing needle (6) which pulls the loop (21) out of the signature (3) through a return stroke motion using a hook (22).

16 Claims, 3 Drawing Sheets

METHOD AND APPARATUS FOR MANUFACTURING BOOK BLOCKS

BACKGROUND OF THE INVENTION

1. Field of the Invention

The present invention relates to a method and apparatus for manufacturing thread-sewn book blocks from a stack of flat sequentially juxtaposed signatures which are sewn together with a double-stranded binding thread penetrating the folds of the signature from the outside and extending along the inside edge of the folds and being pulled out of the folds at an exit point, with the help of parallel stitched seams oriented at right angles to the folds, wherein with each of the stitched seams there is associated a first sewing needle which penetrates a fold with the binding thread from the outside, and a second sewing needle which pulls the binding thread out of the fold at the exit point, wherein there are provided means for joining the binding thread which is guided inseparably in the first sewing needle, with the second sewing needle inside a spread-apart signature.

2. Description of the Related Art

A method of this type is described in EP - A - 0 295 220, wherein the double-stranded binding thread is transferred between the first to the second sewing needle through a thread carrier shuttling translationally back and forth between the two sewing needles.

This process is executed using exclusively mechanical means which are not only expensive and prone to wear, but also require a considerable effort in order to attain the proper adjustment.

These disadvantages led to the object of the present invention, namely to provide a simple method of the type described above for reducing the effort required to transfer the binding thread between the cooperating sewing needles during a sewing operation when mechanical parts are employed, and the wear associated therewith.

SUMMARY OF THE INVENTION

The object of the present invention is that a section of the double-stranded binding thread inserted by the first sewing needle between the legs of a signature is captured by a gas jet and transferred to the second sewing needle.

The invention uses a novel approach and uses energy already available for sewing signatures, and the proposed solution has even surprised the technical experts in the respective field of application.

In order to facilitate conveying the binding thread to the second sewing needle, the binding thread is transferred—after having been pulled into a signature and the first sewing needle is withdrawn—to the second sewing needle in form of an open loop produced by the gas jet.

The length of the open loop to be formed is advantageously selected according to the distance between the first and the second sewing needle. In a preferred embodiment, the length of the open loop is to be dimensioned in such a way that the loop is capable of encircling the movement path of the second sewing needle.

In an apparatus for carrying out the method, there are provided, among others, conveying means for transporting of signatures to a sewing station which includes at least one sewing device formed of a first and a second driven sewing needle for forming two stitched seams on the back of a book block as well as a sewing table associated therewith for conveying the signatures to the sewing device and for carrying out the sewing operation, wherein the apparatus is further provided with a gas line disposed inside the saddle-shaped sewing table, wherein the gas jet emerging from the outlet opening of the gas line and acting on a section of the pulled-in binding thread can be oriented in such a way that a loop extending over the movement path of the second sewing needle is formed.

Advantageously, there is disposed in the gas jet in front of the second sewing needle a guide acting on the section.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Referring now to FIGS. 1*a* to 1*f*, there will be described how the method of the invention is applied.

Figure 1A:
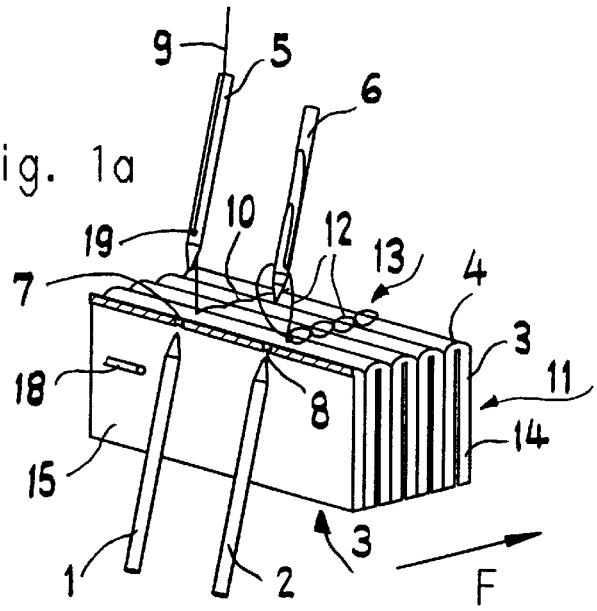
FIG. 1*a* to 1*f* is a method of the invention depicted step by step.

In FIG. 1*a*, the pre-punch needles 1 and 2 are on the return stroke, after having pierced or pre-punched the fold 4 of the signature 3, half of which is shown and which is positioned on a saddle-shaped sewing table (not shown), with a work stroke extending upwardly from below. Located above the pre-punch needles 1 and 2 and aligned with their movement path, there are associated with the pierced holes 7, 8 the first sewing needle 5 and the second sewing needle 6 which have just moved out of their home position. Whereas the first sewing needle 5 conveys a binding thread 9 withdrawn from a supply or from a bobbin and forms a first stitched seam 10 on the back of the depicted book block 11, the second sewing needle 6 makes a second stitched seam 13 formed of loops 12.

The binding thread 9 is guided by the eye 19 of the first sewing needle 5 and is inseparably connected therewith.

Figure 1B:
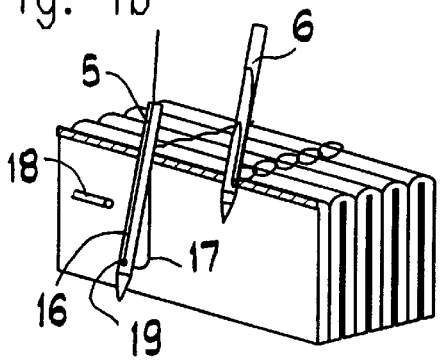

Referring now to FIG. 1*b*, the pre-punch needles 1, 2 have in the meantime retreated downwardly into their rest position, and the first sewing needle 5 and the second sewing needle 6 have penetrated the fold 4 of the signature 3 to be stitched, albeit with a slight delay therebetween. During this step, the first sewing needle 5 has inserted binding thread 9 between the spread-apart legs 14, 15 of a signature 3, whereby initially two sections 16, 17 of the binding thread 9 are formed on the first sewing needle 5 between the eye of the needle 19 and the fold 4. In addition, the second sewing needle 6 penetrates the last formed loop 12, which fits closely with the second sewing needle 6 when the binding thread 9 is withdrawn.

Figure 1C:
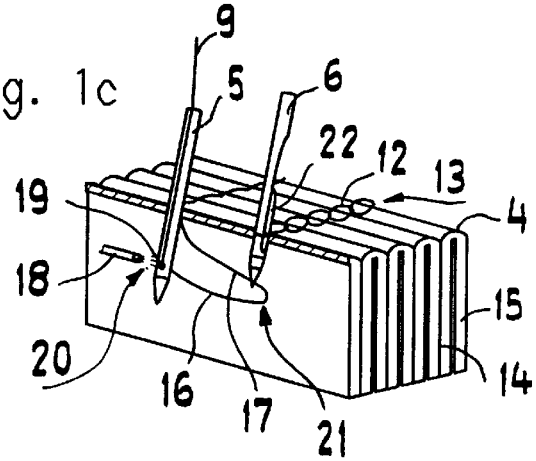

In FIG. 1*c*, there is depicted the withdrawn first sewing needle 5 and an end of a gas line 18, with the opening of the gas line 18 directed towards a portion of section 16 and section 17 protruding from the eye of the first sewing needle 5. An injected gas jet or air jet 20, respectively, creates an open loop 21 from the sections 16, 17, with the closed end of the loop 21 extending over the movement path of the second sewing needle 6 and encircling the same. The gas jet 20 which is usually generated by a compressor (not shown) using air, can be effectively controlled by the withdrawal motion of the first sewing needle 5.

After the second sewing needle 6 has rotated 180°0 about its longitudinal axis, the second sewing needle 6 is ready to penetrate the loop 21 through a stroke motion which extends deeper into the signature 3. The design of the second sewing needle 6 is characterized by a hook 22 extending upwardly, which has the purpose to grasp the binding thread 9 at the loop 21 during the return stroke and to pull the binding thread 9 through the fold 4 out of the signature 3. It should be noted here that the previously penetrated last loop 12 of the second stitched seam 13 is not pulled up with the grasped loop 21, which is the reason why the second sewing needle 6 is rotated by 180°0 before it is withdrawn, i.e. before the hook 22 reaches the loop 12. According to FIG. 1*c*, the second sewing needle 6 rotates after having penetrated the fold 4.

Figure 1D:
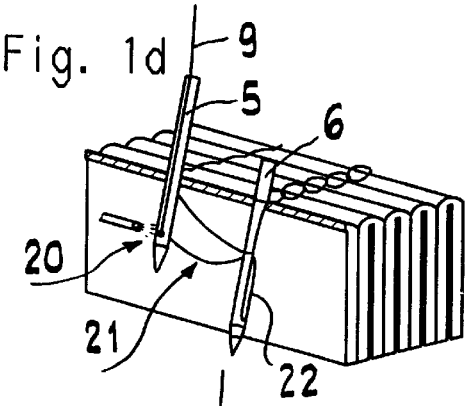

In FIG. 1*d*, the first sewing needle 5 is still in its withdrawn position within the signature 3, while the second sewing needle 6 has attained its deepest penetration, wherein the loop 21 controlled by the gas jet 20 is located above the hook 22. The binding thread 9 is then withdrawn, until the loop 21 contactingly encircles the sewing needle 6.

Figure 1E:
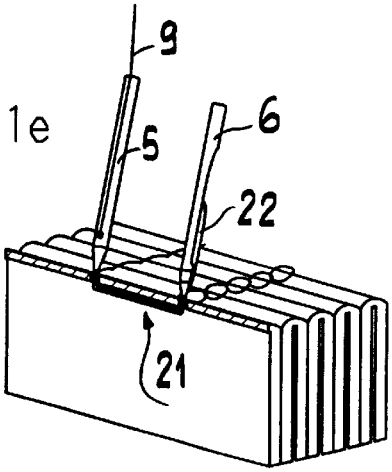

Following a return stroke motion of both sewing needles 5, 6, the situation depicted in FIG. 1*e* is attained, wherein the first sewing needle 5 exits along the binding thread 9 and the second sewing needle 6 exits from the fold 4 with the loop 21 grasped by the hook 22, so that the sections 16, 17 or a portion of the loop 21 contact the inside edge of the fold 4.

Figure 1F:
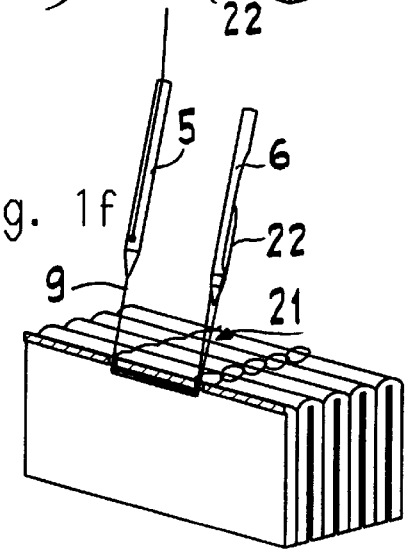

In FIG. 1*f*, there are depicted the sewing needles 5, 6 in the home position with the loop 21 pulled up and binding thread 9 pulled taut. The process is repeated for each signature 3, with the signatures 3 conveyed individually and carried away in the direction of the arrow F together with the stitched book block 11. The stitched stack of signatures is separated into book blocks by cutting the binding thread 9 above the transverse seams with the help of a mechanical cutting device (see, for example, EP - A - 0 295 220).

Figure 2:
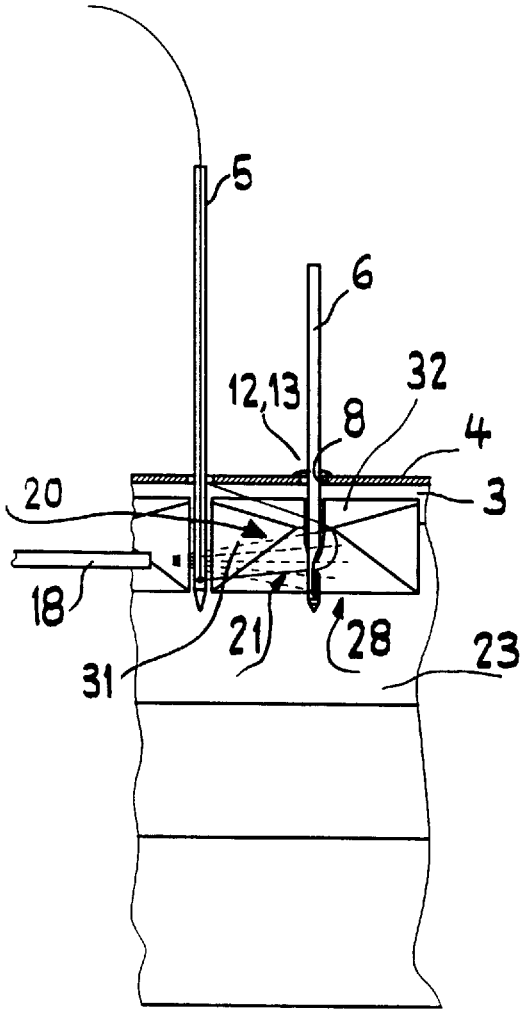
FIG. 2 a section through the longitudinal axis of an embodiment of the apparatus of the invention taken along the line II—II of FIG. 3.
Figure 4:
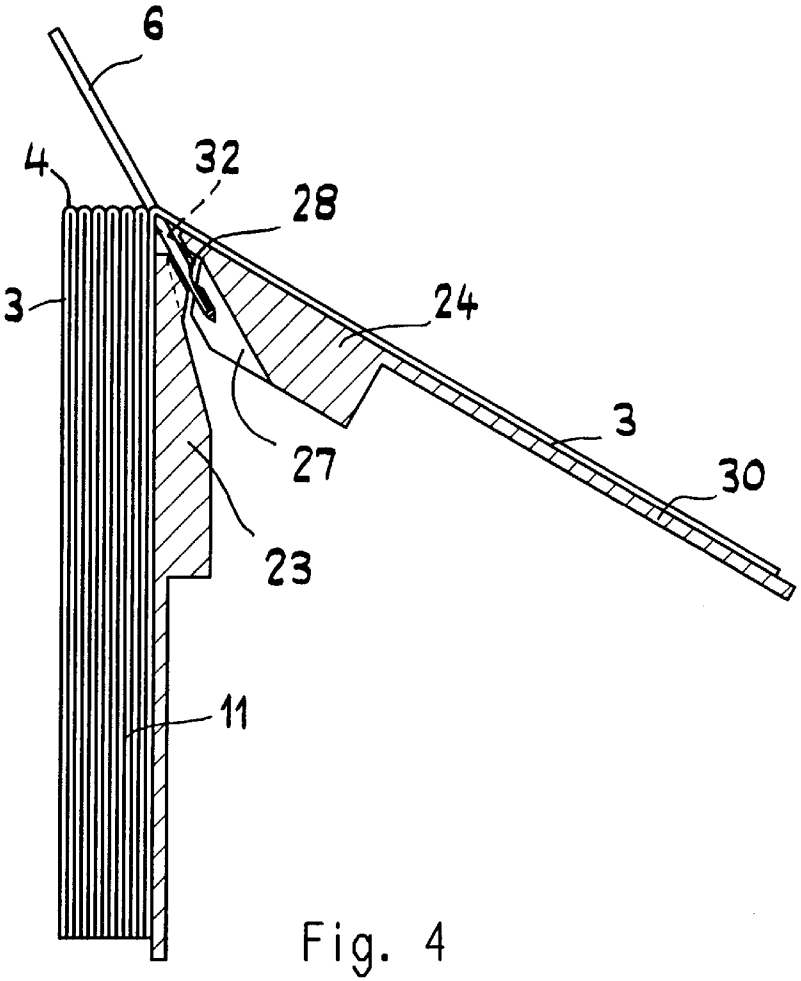
FIG. 4 a cross-sectional view along the second sewing needle of the embodiment of FIG. 2.
Figure 3:
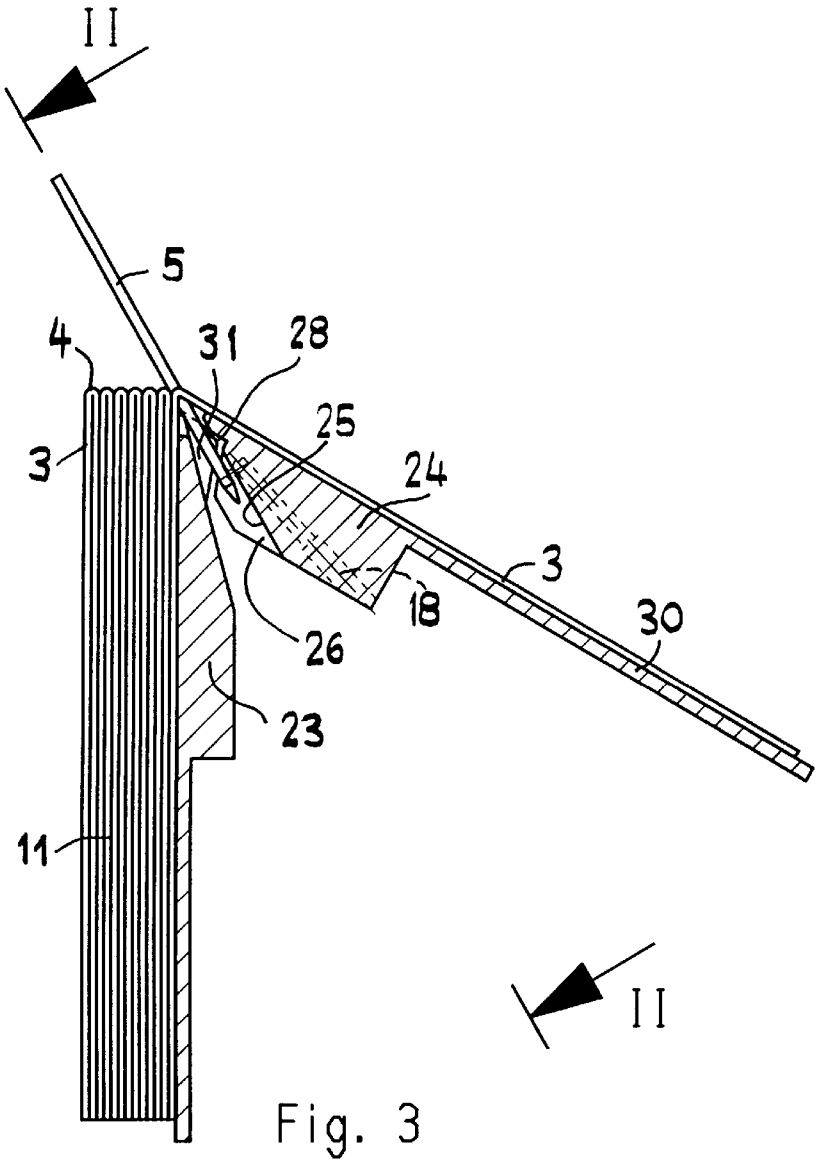
FIG. 3 a cross-sectional view along the first sewing needle of the embodiment of FIG. 2.

Referring now to FIGS. 2 to 4, there is illustrated an embodiment of an apparatus operating according to the method of the invention. In FIG. 2, there is illustrated a situation similar to that of FIG. 1*d*, wherein the first sewing needle 5 is withdrawn so that the loop can be formed, while the second sewing needle 6 on its return path is about to grasp the loop 21 formed by the gas jet 20. This necessitates the addition of design features to the saddle-shaped sewing table which is represented by the guide members 23, 24 provided to aid in the formation of a loop 21; the guide member 24 is provided on the side facing the guide member 23 with a longitudinal guide 25 facing the first sewing needle 5 and operative approximately along the insertion length of the first sewing needle 5, which prevents an excursion of the binding thread 9 towards this side even during the return stroke of the first sewing needle 5. On the opposite side of guide member 24, the guide member 23 and the side walls 26 of the longitudinal guide 25 which are inclined on both sides towards to the longitudinal guide 25, form a clearance zone into which section 17 from the first sewing needle 5 can expand. Section 17 can be shaped into a loop 21 with the help of a gas or air jet exiting from a gas line 18 disposed in the guide member 24 and impinging on the section 17 of the binding thread from the side at a right angle, with the loop 21 extending over the movement path of the second sewing needle 6 which drops into the sewing table through the fold 4 of the signature 3 to be stitched. In order for the second sewing needle 6 to be able to drop into the guide member 24, the guide member 24 is provided with a recess 27 which extends parallel to the longitudinal guide 25 of the first sewing needle 5 and is formed by the guide surfaces 26 which are inclined on both sides towards the longitudinal guide 25.

The gas jet exiting from one of the guide surfaces 26 blows the section 17 across the opposite side face 31, 32 and the movement path of the second sewing needle 6, so that during the return stroke, the second sewing needle 6 is able to grasp the loop 21 with the hook 22 formed on the second sewing needle 6 and to pull the loop 21 out of the signature 3 through the fold 4. Subsequently, the bound book block 11 is moved onward in the direction F and simultaneously lifted from the sewing table 30 when the sewing table 30 pivots back.

For displacing the section 17 with respect to the second sewing needle 6, there is operatively disposed on the guide member 23 a loop guide 28 jutting out towards and forming a constriction in conjunction with the guide member 24, with the loop guide 28 defining a constant position of the loop 21 relative to the second sewing needle 6.

This loop guide 28 is provided on both sides of the second sewing needle 6 and has continuously sloping surfaces of a pyramid (see FIG. 2). FIG. 3 shows the pyramid behind the first sewing needle 5, whereas FIG. 4 shows the second sewing needle 6 penetrating the pyramid.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for manufacturing thread-sewn book blocks from a stack of flat sequentially juxtaposed signatures which are sewn together with a double-stranded binding thread penetrating the folds of the signature from the outside and extending along the inside edge of the folds and being pulled out of the folds at an exit point, with the help of parallel stitched seams oriented at right angles to the folds, comprising the steps of associating with each of the stitched seams a first sewing needle which penetrates a fold with the binding thread from the outside;

pulling the binding thread out of the fold at the exit point with a second sewing needle;

providing joining means for joining the binding thread which is guided inseparably in the first sewing needle, with the second sewing needle inside a spread-apart signature;

capturing by a gas jet a section of the double-stranded binding thread inserted by the first sewing needle between the legs of a signature; and transferring the section of the double-stranded binding thread to the second sewing needle.

2. The method according to claim 1, further comprising the step of transferring the inserted section, after the first sewing needle has been withdrawn, to the second sewing needle by forming an open loop produced by the gas jet.

3. The method according to claim 2, wherein a work stroke of the first sewing needle corresponds substantially to the spacing between the sewing needles.

4. The method according to claim 2, wherein the length of the open loop corresponds at least to the spacing between the first and the second sewing needle.

5. The method according to claim 4, wherein the closed end of the loop is laid out in such a way as to at least approximately encircle the movement path of the second sewing needle.

6. The apparatus according to claim 5, wherein the first sewing needle (5) provides for a return stroke which corresponds in size substantially to a spacing between the first and the second sewing needles (5, 6).

7. An apparatus for manufacturing thread-sewn book blocks from a stack of flat sequentially juxtaposed signatures which are sewn together with a double-stranded binding thread penetrating the folds of the signature from the outside and extending along the inside edge of the folds and being pulled out of the folds at an exit point, with the help of parallel stitched seams oriented at right angles to the folds, comprising:

a conveyor for transporting of signatures (3) to a sewing station, including at least one sewing device formed of a first (5) and a second (6) driven sewing needle for forming two stitched seams on the back of a book block, and a saddle-shaped sewing table (30) which can be controllably driven by clock pulses, for conveying the signatures (3) to the sewing device and for carrying out the sewing operation; and wherein there is disposed inside the sewing table (30) an outlet opening of a gas line (18) connected to a pressure source to produce a gas jet, the outlet opening being oriented towards a section of the binding thread (9) adapted to form an open loop (21) and towards the movement path of the second sewing needle (6).

8. The apparatus according to claim 7, further comprising a guide in the gas jet, disposed in front of the second sewing needle (6).

9. The apparatus according to claim 7, wherein the sewing table (30) comprises guide means associated with formation of loops and disposed along an insertion length of the first and second sewing needles (5, 6).

10. The apparatus according to claim 9, wherein the guide means are formed by two guide members (23, 24) connected to the sewing table (30) on both sides of a plane defined by the first and second sewing needles (5, 6).

11. The apparatus according to claim 10, wherein the guide members (23, 24) comprise loop-forming means located in the region of the first sewing needle (5) promoting through the gas jet the formation of a loop in the sections (16, 17) of the binding thread (9) pulled into a signature (3), in such a way that when the first sewing needle (5) is withdrawn into a position adapted for the formation of a loop, the one partial section of section (16) remains in contact with the first sewing needle (5) in a longitudinal guide (25) of the guide member (24), while the other partial section of section (16) is pulled by the gas jet through the eye (19) of the first sewing needle (5) and forms a loop (21) at the guide member (23) which is spaced apart from the first sewing needle (5).

12. The apparatus according to claim 11, wherein the longitudinal guide (25) disposed in the guide member (24) comprises sloping guiding surfaces (26) on both sides of the movement path of the first sewing needle (5).

13. The apparatus according to claims 12, wherein each of the sloping guiding surfaces (26) comprises a respective outlet opening of the gas line (18) oriented in the direction opposite to at least one of the movement path of the first sewing needle (5) and the section (17) of the binding thread.

14. The apparatus according to claim 12, wherein the guide member (24) comprises a longitudinal groove (29) associated with the second sewing needle (6).

15. The apparatus according to claim 14, wherein the guide member (23) comprises a loop guide (28) for receiving a loop (21) formed by the sections (16, 17) of the binding thread.

16. The apparatus according to claim 15, wherein the loop guide (28) is formed in the shape of a truncated pyramid having two sides (31, 32) with edges, and wherein one of the edges formed by two sides extends from substantially the region of the sewing table which is closest to the saddle from the first sewing needle (5), diagonally towards the second sewing needle (6).

* * * * *